US006857358B2

(12) United States Patent
Dittrich et al.

(10) Patent No.: US 6,857,358 B2
(45) Date of Patent: Feb. 22, 2005

(54) DEVICE AND METHOD FOR MARKING CIGARETTE PACKETS

(75) Inventors: Andreas Dittrich, Kirchlinteln (DE); Hans-Werner Fuchs, Thurnau (DE); Bernd Rabenstein, Heinersreuth (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 0 days.

(21) Appl. No.: 10/438,387

(22) Filed: May 15, 2003

(65) Prior Publication Data

US 2004/0079243 A1 Apr. 29, 2004

(30) Foreign Application Priority Data

May 16, 2002 (DE) ..... 102 21 837

(51) Int. Cl.[7] ..... B41F 17/00; B65B 61/26; B65B 61/02; B65G 47/31

(52) U.S. Cl. ..... 101/35; 101/DIG. 30; 250/319; 356/240.1; 131/282; 53/51

(58) Field of Search ..... 101/35, DIG. 30, 101/3.1; 250/319; 356/240.1; 131/282, 283; 53/51

(56) References Cited

U.S. PATENT DOCUMENTS

| | | | | | |
|---|---|---|---|---|---|
| 4,738,073 | A | * | 4/1988 | Mattei et al. | 53/51 |
| 5,186,184 | A | * | 2/1993 | Aindow et al. | 131/281 |
| 6,098,533 | A | * | 8/2000 | Polloni et al. | 101/3.1 |
| 6,516,811 | B1 | * | 2/2003 | Focke et al. | 131/283 |
| 2001/0010332 | A1 | | 8/2001 | Bismarck et al. | |
| 2001/0032932 | A1 | | 10/2001 | Focke et al. | |

FOREIGN PATENT DOCUMENTS

| | | |
|---|---|---|
| DE | 100 04 022 A1 | 8/2001 |
| WO | WO 01/54986 A1 | 8/2001 |
| WO | WO 02/04297 A1 | 1/2002 |

* cited by examiner

*Primary Examiner*—Andrew H. Hirshfeld
*Assistant Examiner*—Marissa Ferguson
(74) *Attorney, Agent, or Firm*—John F. Salazar; Steven A. Wittern; Middleton Reutlinger

(57) ABSTRACT

The invention relates to a device and a method for marking cigarette packets, comprising a transport device for conveying at least one cigarette packet to a marking station for marking cigarette packets, and the following features: the transport device grasps a batch of adjacent, aligned cigarette packets and moves them to the marking station, where the transport device releases the batch; and the released cigarette packets are marked on at least one exposed area.

4 Claims, 2 Drawing Sheets

DEVICE AND METHOD FOR MARKING CIGARETTE PACKETS

CROSS REFERENCE TO PRIOR APPLICATION

This application claims priority to German Patent Application No. 102 21 837.4, filed on May 16. 2002, which is incorporated herein by reference.

BACKGROUND OF THE INVENTION

1. Technical Field

The present invention relates to a device and a method for marking cigarette packets. In particular, the present invention relates to a device and a method for marking cigarette packets with information for manufacturers and/or retailers and/or customers, for example information about the time and aggregate of manufacture, the company, authenticity, progression of delivery or also customer information, in plain writing or encoded.

2. Description of the Related Art

In the past, such information has been impressed onto the foil section of a cigarette packet or applied to it in some other way, such that the packet had to be opened to read the information. Methods later became known for applying information to the outer side of the cigarette packet, for example by ink jet printing or laser labeling. There exists here in principle the requirement that the flow of cigarette packets during production is, as far as possible, not interrupted or stopped.

WO 01/54986 discloses a method and an arrangement for marking cigarette packets, wherein the cigarette packets are placed on a conveyor belt and are guided past a marking means, for example a laser or printing device. It is not ensured during marking that the cigarette packets are held stably on the conveyor belt. This can lead to inaccuracies during marking.

WO 02/04297 discloses a device for marking in which opposite side areas of the cigarette packets are clamped by two continuous belts running in parallel, and guided past a printing device. Either side sections of a cigarette packet protruding from the continuous belt only or side areas not clamped by the conveyor belts can be printed on. Therefore, comparatively large side areas of a cigarette packet cannot be marked, which restricts the marking possibilities.

DE 100 04 022 A1 discloses a method and a device for attaching coding to cigarette packets which are either designed comparably to WO 02/04297 A1 or in which cigarette packets are guided in a circle in a drying revolver and labeled using a laser. In this arrangement, too, the area available for marking is subject to equipment-related restrictions.

SUMMARY OF THE INVENTION

It is an object of the present invention to develop the device and the method in accordance with the generic WO 02/04297 A1, to the effect that the cigarette packets can be even more reliably marked and can be subject to even fewer restrictions, in particular with regard to the area available for marking.

This object is solved by a device for marking cigarette packets comprising a transport device for conveying at least one cigarette packet to a marking station for marking cigarette packets; characterized by the following features: the transport device grasps a batch of adjacent, aligned cigarette packets and moves them to the marking station; where the transport device releases the batch; and the released cigarette packets are marked on at least one exposed area. Advantageous developments are the subject of the dependent sub-claims.

A device for marking cigarette packets in accordance with the present invention includes a transport device for conveying cigarette packets to a marking station for marking the cigarette packets. While in the prior art, the cigarette packets are guided past a marking device predominantly individually, in accordance with the invention the cigarette packets are transferred to a marking station, where they are marked, in batches. In accordance with the present invention, the transport device thus grasps a batch of adjacent, aligned cigarette packets and moves it to the marking station where the transport device releases the batch again and the released cigarette packets are labeled on at least one exposed area.

Advantageously, the batch consisting of adjacent, aligned cigarette packets exhibits a certain inherent stability, such that mechanical disruptions, for example vibrations caused by conveying means, jolting movements, etc., have less influence on the positioning of cigarette packets. Thus, in accordance with the invention, fewer holding and stabilizing measures are required, in order to reliably position the cigarette packets for marking. In particular, it is possible in accordance with the invention to clamp the cigarette packets only on comparatively small areas or not at all while they are marked, such that as a rule, at least three areas of a cigarette packet are available for marking.

Handling the packets as batches is additionally advantageous because this can reduce the idle times during transport. At the same time, it is possible to better utilize labeling fields of, for example, a laser, since these labeling fields can extend over a number of packet side areas. The number of packets in the batch should therefore be adjusted to the size of the labeling field.

During marking, the cigarette packets are preferably placed, via a side area, on a substantially plane support area, for example a conveyor belt, a plate or a tabular clamping device. In this way, side areas of adjacent cigarette packets in the released batch automatically lie full-face adjacent to each other, such that comparatively large static frictional forces operate which prevent cigarette packets from shifting or slipping, for example as a result of mechanical disruptions. Advantageously, the cigarette packets can be more reliably positioned in a simple way.

During marking, the cigarette packets are preferably placed, via their narrow sides, on the substantially plane support area, i.e. are arranged edgeways. While an individual cigarette packet arranged edgeways is comparatively susceptible to tipping over, a batch of adjacent, aligned cigarette packets arranged edgeways is significantly less susceptible to tipping over. Thus, in accordance with the invention, narrow sides in particular, in particular the narrow sides opposite the support, of cigarette packets can be reliably marked using comparatively few holding and stabilizing measures. To this end, a jointly handled batch includes at least a enough cigarette packets that the length of the batch in the transport direction is larger than or equal to the broadside of a cigarette packet.

During marking, a batch in the marking station is preferably additionally fixed, such that the cigarette packets substantially cannot slip or tip over, at least during marking. In this way, even more reliable positioning is achieved. The transport device itself, or an additional fixing device, can be used for fixing. For fixing, the batch in the marking station can be clamped, contacted, mechanically guided or can abut a stopper on one side or be fixed in some other way using the action of mechanical forces, at sections of a cigarette packet which are not to be marked. The fixing force can act on all the cigarette packets of a batch in the marking station, but can also act only on a few selected cigarette packets of a batch, in particular on the front and rear cigarette packets—viewed in the conveying direction—of the released batch.

The transport device or fixing device serving to fix the cigarette packets is preferably designed so as to be adjustable, in order to be able to move back and forth between a resting position in which it has substantially unimpeded access to all the side areas of cigarette packets of the batch, so far as they are not hidden by transport units, and a fixing position in which the transport device or the fixing device acts, at least in sections, on side areas of cigarette packets.

The transport device is preferably designed so as to not only grasp and transport one batch of adjacent, aligned cigarette packets but also to grasp and transport at least one other comparable batch, particularly preferably only one other comparable batch. This advantageously increases the throughput of the device in accordance with the invention. In order to jointly handle at least two batches of adjacent cigarette packets, the transport device can impinge on the at least two batches with substantially identical forces, in particular during marking. For this purpose, the transport device can be designed as a clamping device clamping at least two batches, a conveying device jointly conveying at least two batches, or the like.

In accordance with a first embodiment, the marking device and/or the batch are stationary during marking, which enables even more accurate positioning for marking. In accordance with another embodiment, the batch and the marking device are moved relative to each other, the batch or the marking device preferably being stationary and therefore accurately positioned.

BRIEF DESCRIPTION OF THE DRAWINGS

Preferred example embodiments of the present invention will now be described by referring to the enclosed drawings, in which.

DETAILED DESCRIPTION OF THE PREFERRED EMBODIMENTS

Figure 1:
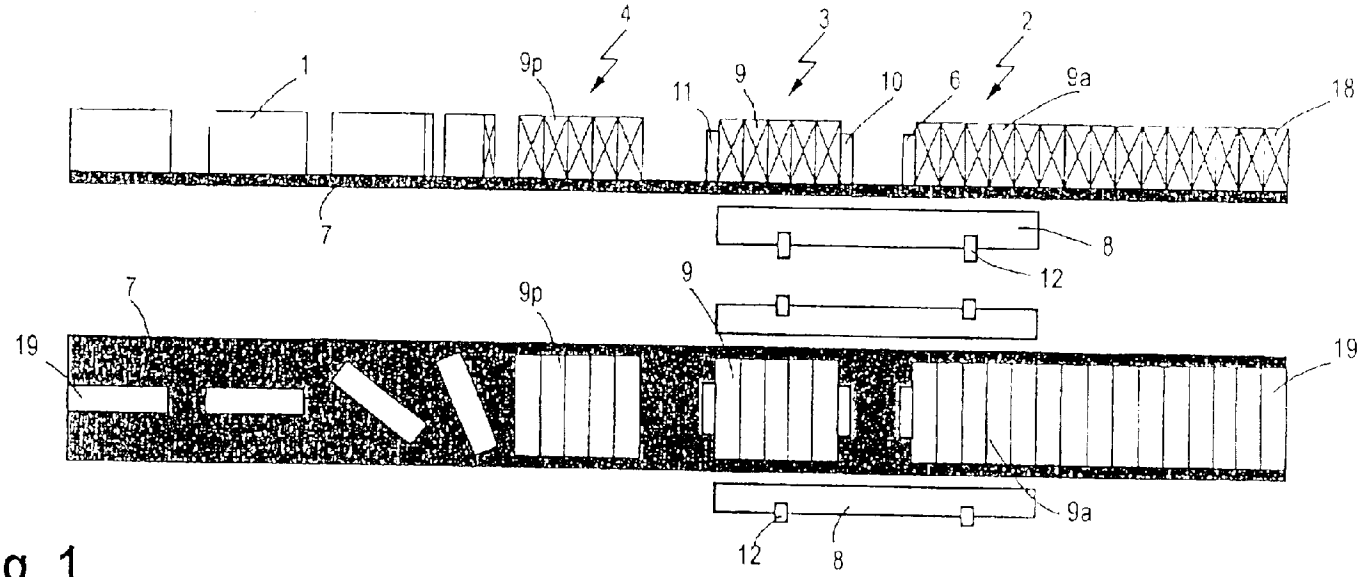
FIG. 1 shows a device for marking cigarette packets in accordance with the present invention in an initial position, in a side view and a top view, respectively.

In the figures, identical reference numerals indicate identical or functionally identical elements and functional groups. FIG. 1 shows a device for marking cigarette packets in accordance with the present invention in an initial position, in a side view and a top view. What is shown is a cutaway from a more extensive cigarette packaging machine in which the cigarette packets 1 are continuously conveyed to the support area 7 in a flow of cigarette packets from right to left, with the aid of a conveying device (not shown). As shown in FIG. 1, the cigarette packets 1 are placed edgeways on the support area 7 via their narrow sides 19, such that the facing sides are freely accessible laterally. The width of the support area 7 in FIG. 1 is slightly larger than the length of a narrow side 19, in order to enable the cigarette packets 1 to be held stably. The cigarette packets 1 can, however, also protrude laterally beyond the edge of the support area 7 on at least one side.

The device in accordance with FIG. 1 substantially includes three stations, namely—in the order of processing—an accumulating station 2, a marking station 3 and a separating station 4. The cigarette packets 1 arriving individually or adjacently from the right are accumulated at the accumulating station 2 where they form a batch of cigarette packets 9*a* which are adjacent via their broadsides and aligned. For blocking the flow of cigarette packets arriving from the right, a block 6 is provided which protrudes into the flow. As is clear to the person skilled in the art, the block 6 can be replaced by a clamping, holding or fixing unit known in its own right. The block 6 is preferably stationary in the plane of projection, but can also—where the support area 7 is a conveyor belt—run on retarded with the conveyor belt 7. A relative speed of other than zero between the block 6 and the conveyor belt 7 is essential, in order to enable accumulating.

At least one marking device (not shown) is arranged in the marking station 3, in order to mark the batch 9 situated in the marking station 3. For marking, the following methods can for example be used: printing, for example by means of ink jet printers, laser printers, thermo-sublimation printers, applied printing techniques, for example offset printing methods, punching methods, ablative techniques, for example laser ablation, or other surface-manipulating methods, for example local heat treatment, magnetization, labeling, etc.

Using the method in accordance with the invention, any type of marking can in principle be applied, for example as a barcode or an encoded dot matrix.

In the initial position, as shown in FIG. 1, three side areas of the cigarette packets 1 are freely accessible, namely the two facing sides 18 and the upper narrow side 19. These side areas, and for instance sections of the lower narrow side 9 protruding laterally from the conveyor belt 7, are accessible substantially unimpeded.

Downstream of the marking station 3, a separating station is 4 provided in which a batch of five, just transferred from the marking station 3, is positioned. In the separating station 4, separating means (not shown) act on the cigarette packets of the downstream batch 9*p*, in order to separate the cigarette packets. As shown in FIG. 1, the separating means rotate the cigarette packets 1 by 90° in the longitudinal direction, such that the cigarette packets exit the device edgeways, on a narrow side 19 and preferably spaced out from each other. Downstream of the device are other handling units, for example a cellophane wrapping station (not shown) and/or a packaging device for packaging cigarette packets already wrapped in cellophane, which are preferably transported in batches of five, into cartons.

In principle, a cellophane wrapping device can also be arranged upstream of the device shown in FIG. 1, and the cellophane wrapper or a marking area attached to it can be marked.

As shown in FIG. 1, the cigarette packets 1 of the batch 9 in the marking station 3 are fixed by clamping devices 10, 11. The clamping devices 10, 11 are preferably stationary in the plane of projection of FIG. 1; in principle, however, they can also move in the conveying direction retarded—in particular at the same speed as the block 6—along with a support area 7 designed as a conveyor belt. As may be gathered from the figures, the block 6 and the clamping devices 10, 11 are movable, in order to not encroach on the flow of cigarette packets in a first position and to encroach on the flow of cigarette packets in a second position, in order to handle cigarette packets 1. The block 6 and the clamping devices 10, 11 can in particular be adjusted, pivoted or moved in some other appropriate way, horizontally and/or vertically.

Two transport devices 8, arranged laterally with respect to the support area 7, can be adjusted—for example moved vertically and/or horizontally, folded up, pivoted or the like—by means of schematically shown adjusting means 12, in order to be out of encroachment with the flow of cigarette packets 1 in a first position and to grasp a batch of adjacent, aligned cigarette packets and transport them as a batch in a second position. In FIG. 1, the transport device includes two cuboid-shaped clamping jaws 8 arranged symmetrically with respect to the support area 7, which release the batches 9, 9*a* of cigarette packets in the first position and grasp, in particular laterally clamp, and transport them in the second position.

As shown in FIG. 1, the two clamping jaws 8 symmetrically bridge the gap between the block 6 and the clamping device 10 and can grasp an identical number of cigarette packets as batches 9, 9*a* in the accumulating station 2 and in the marking station 3, in the second position. Although batches of five are shown in each of the figures, the transport device can in principle grasp any other number of cigarette packets 1 simultaneously and transport them on.

Figure 3:
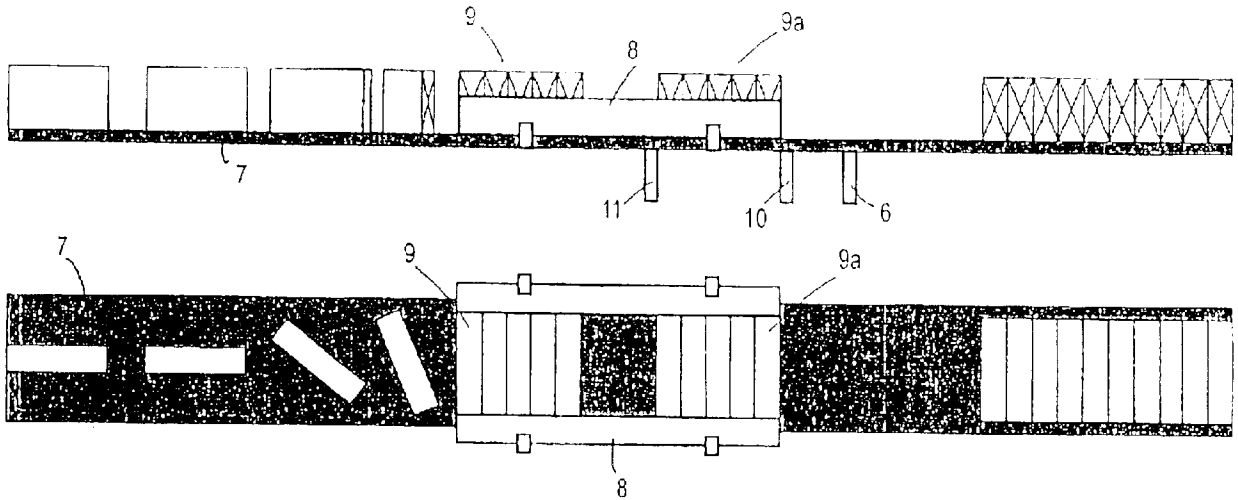
FIG. 3 shows the device in accordance with FIG. 1, directly after two batches of cigarette packets have been transported, in a side view and a top view, respectively.

In addition to the clamping jaws 8 and the adjusting means 12, the transport device 8 includes a motorized adjusting means (not shown), such that the transport device can be transferred from the initial position shown in FIG. 1 to the end position shown in FIG. 3 and moved back. An operating method of a device in accordance with the invention will now be described by way of example.

The cigarette packets 1 accumulated in the accumulating station 2 are present in the form of a batch of identically orientated, adjacent and aligned cigarette packets. In FIG. 1, the block 6 protrudes into the flow of cigarette packets 1. The batch 9*a* of five in front of the block 6 forms the next batch of cigarette packets to be marked. The clamping devices 10, 11 protrude into the flow of cigarette packets 1 in FIG. 1 and fix the batch 9 currently situated in the marking station 3, such that the securely held cigarette packets 1 can be reliably marked. The downstream batch 9*p* in the separating station 4 is ready for separation. In FIG. 1, the transport device 8 is situated in the first position, out of encroachment with the batches 9, 9*a*. In this position, three side areas of the cigarette packets 1 are preferably accessible, substantially unimpeded.

Figure 2:
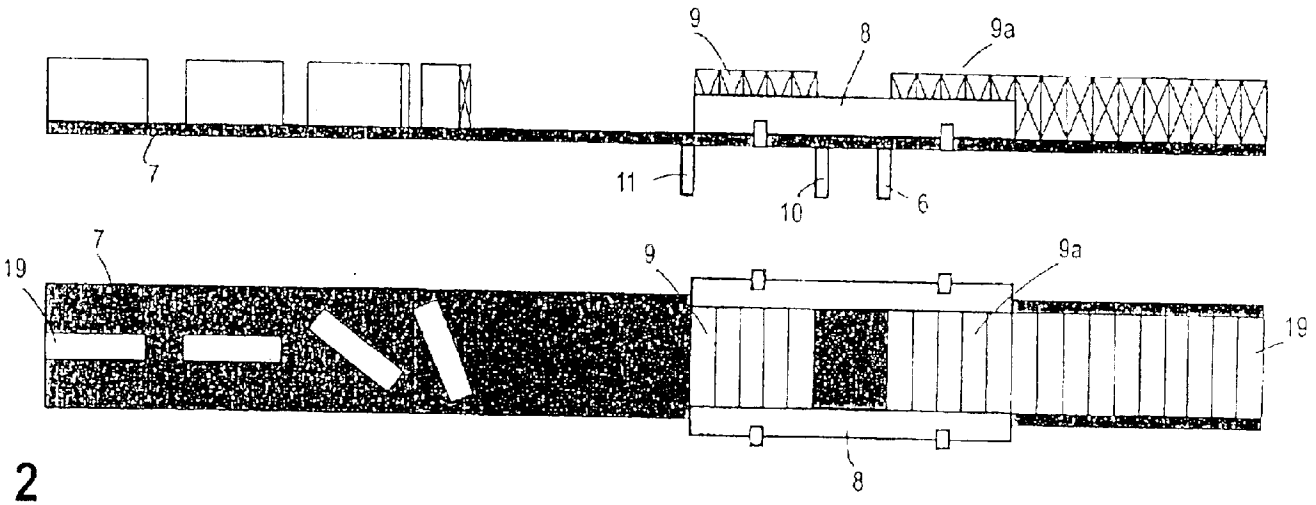
FIG. 2 shows the device in accordance with FIG. 1, directly before two batches of cigarette packets are transported, in a side view and a top view, respectively.

FIG. 2 shows the device in a side view and a top view, directly before batches 9, 9*a* are transported. To prepare for transport, the transport device 8 is moved to the second position, in order to grasp, for example laterally clamp, the batches 9, 9*a*. Furthermore, the block 6 and the clamping devices 10, 11 are transferred to a second position in which they no longer encroach on the flow of cigarette packets 1. As shown in FIG. 2, the previously marked batch 9*p* has in the meanwhile been separated and transported away.

In order to transport the batches 9, 9*a*, the motorized adjusting means (not shown) of the transport device 8 is activated by means of a control means (not shown). The transport device 8 is then transferred from the initial position in accordance with FIGS. 1 and 2 to the end position in accordance with FIG. 3. For transporting, the batches 9, 9*a* can be raised vertically from the support area 7. While the batches 9, 9*a* are transported on, the block 6 and the clamping devices 10, 11 remain out of encroachment, i.e. in the second position. The distance by which the two batches 9, 9*a* are transported corresponds substantially to the sum of the length of an individual batch 9, 9*a* and the distance between the block 6 and the clamping device 10. Because the batches 9, 9*a* have been transported on, a gap arises in the accumulating station 2, in the example shown a gap of about 3 to 4 cigarette packets 1. In order to ensure as high a throughput of the system as possible, the time required to transport, mark and release the batches 9, 9*a* and to guide the transport device 8 back broadly corresponds to the time required to transport on a number of cigarette packets 1 which corresponds to the gap caused by transporting on the batches 9, 9*a*. The timing of the device is selected accordingly.

The compact batch is transferred to the marking station, where it is marked, for example by printing by means of ink jet printers, laser printers, laser ablation or comparable methods. All three exposed sides of the cigarette packets 1 can be marked. The marking can be situated on one, two or three sides, at one point or also at a number of points on each side, respectively. Each packet can be individually marked in sequence, or all the packets can be marked simultaneously. The cigarette packets are processed in the marking station as a batch, as opposed to the packet-for-packet marking known from the prior art.

During marking, the marking device—for example a printing device—and/or the batch 9 can be stationary or the batch and the marking device can move relative to each other. The batch 9 can be fixed during marking, to which end the transport device 8—in particular, the lateral clamping jaws shown in the figures—or the clamping devices 10, 11 re-introduced into the flow of cigarette packets can be used.

As shown in FIG. 3, the batch 9 previously situated in the marking station 3 has at the same time been transferred to the separating station 4 during transport, in order to be separated there, once released, as the batch 9*p*.

Figure 4:
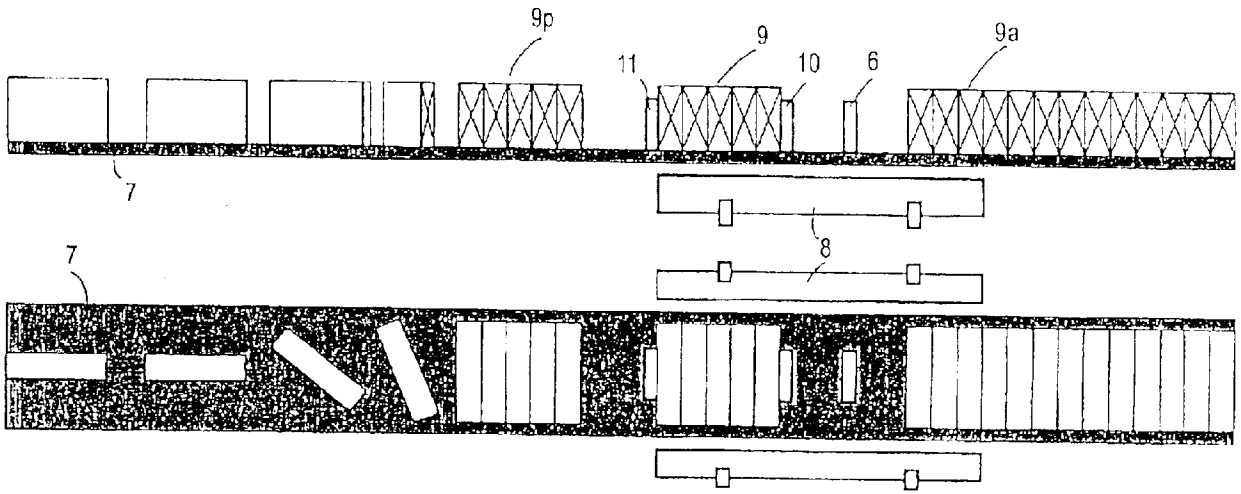
FIG. 4 shows the device in accordance with FIG. 1, shortly before it reaches the initial position shown in FIG. 1, in a side view and a top view, respectively.

FIG. 4 shows the device directly before it returns to the initial position in accordance with in FIG. 1. In order to guide the transport device back, the two lateral clamping jaws 8 release the batches 9, 9*a*, the clamping jaws 8 are raised and retracted upstream to the initial position in accordance with FIG. 1. Lastly, the clamping jaws 8 are moved vertically downwards. Furthermore, the block 6 and the clamping devices 10, 11 return to the first position, in order to encroach on the flow of cigarette packets 1, wherein the clamping devices 10, 11 automatically clamp the batch 9*a* transferred from the accumulating station 2 to the marking station 3, as the batch 9. As may be seen in FIG. 4, the gap between the front end of the flow of cigarette packets and the block 6 has not yet been closed up. This gap is eventually closed up by continuing to supply cigarette packets 1, such that the state in accordance with FIG. 1 is assumed again.

As can be gathered from the figures, the transport device is designed such that both the batch 9*a* in the accumulating station and the batch 9 in the marking station can be grasped, such that the two batches 9, 9*a* can be transported on simultaneously.

Appropriate conveying means, for example conveyor belts, are provided for supplying the packets to the accumulating station 2 and for transporting the packets away from the separating station 4. The support area 7 in the region of the marking station 3, by contrast, is preferably immobile, in particular designed as a substantially plane support area, the batches 9, 9*a* in the device shown preferably being transported exclusively by means of the transport device 8.

The marking devices used can be situated laterally with respect to the marking position and/or above the marking position and can also in principle be held movably, in order to approach the batch 9 to be marked only when the batch is to be marked and/or fixed.

The device in accordance with the invention can easily be integrated into conventional cigarette packaging units, in particular also as an autonomously operating unit which co-operates in coordination with the other components of a packaging machine. In such an arrangement, the cigarette packets entering the device in accordance with the invention are pushed by means of conventional conveying means, in particular conveyor belts, onto the support area 7 where they are marked and, once separated, supplied to the other units of the packaging machine.

In the foregoing description, preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A method for moving cigarette packages to a marking station, comprising:

aligning cigarette packages behind a block in side by side relationship on a non-movable surface at an accumulation station;

grasping a batch of said packages from behind said block by opposing first and second clamping jaws;

moving laterally said first and said second clamping jaws to position said batch of packages at a marking station;

releasing said packages from said first and said second clamping jaws;

marking said packages;

grasping said back of packages at said marking station by said first and said second clamping jaws;

moving said packages from said marking station to a separating station.

2. The method of claim 1 wherein said first and second clamping jaws grasp said batch of packages at said marking station and at said accumulation station at the same time.

3. The method of claim 2 further comprising lowering said block at said accumulation station before moving said batch of packages to said marking station.

4. The method of claim 3 further comprising compressing said batch of packages at said printing station between a first and a second clamping block.

* * * * *